US008083900B2

(12) United States Patent
Lin

(10) Patent No.: US 8,083,900 B2
(45) Date of Patent: Dec. 27, 2011

(54) REMOVAL OF WATER FROM BIO-OIL

(75) Inventor: Ronny W. Lin, Sugar Land, TX (US)

(73) Assignee: Kior Inc., Pasadena, TX (US)

( * ) Notice: Subject to any disclaimer, the term of this patent is extended or adjusted under 35 U.S.C. 154(b) by 0 days.

(21) Appl. No.: 12/853,077

(22) Filed: Aug. 9, 2010

(65) Prior Publication Data

US 2011/0139597 A1 Jun. 16, 2011

(51) Int. Cl.
*C10B 47/00* (2006.01)
*F27B 15/08* (2006.01)

(52) U.S. Cl. ..... 201/12; 201/21; 201/23; 201/25; 422/145; 585/240

(58) Field of Classification Search ..... 201/12, 201/21, 23, 25; 422/143, 145, 147; 585/240, 585/242; 202/99, 120; 196/14.52
See application file for complete search history.

(56) References Cited

U.S. PATENT DOCUMENTS 4,942,269 A * 7/1990 Chum et al. ..... 585/240
5,877,380 A 3/1999 Conroy et al.
5,961,786 A * 10/1999 Freel et al. ..... 202/121
6,485,841 B1 * 11/2002 Freel et al. ..... 428/498
6,555,649 B2 * 4/2003 Giroux et al. ..... 530/200
7,004,999 B2 2/2006 Johnson et al.
7,585,407 B2 * 9/2009 Duyvesteyn et al. ..... 208/390
7,905,990 B2 * 3/2011 Freel ..... 201/12
7,959,765 B2 * 6/2011 Argyropoulos ..... 201/2.5
2007/0125369 A1 * 6/2007 Olson et al. ..... 127/37
2008/0006520 A1 1/2008 Badger et al.
2008/0264771 A1 10/2008 Dam-Johansen et al.
2009/0007484 A1 1/2009 Smith
2009/0139851 A1 6/2009 Freel
2009/0165378 A1 7/2009 Agblevor
2011/0245489 A1 10/2011 Steele et al.

* cited by examiner

*Primary Examiner* — Nina Bhat

(57) ABSTRACT

A process and system for separating water from bio-oil by using a partial condenser. The process comprises partially condensing vapor conversion products from a biomass conversion reaction to produce a water-rich overhead stream and a water-depleted stream comprising condensed bio-oil. The partial condenser removes a substantial portion of the water from the bio-oil, while providing an effective and flexible process for producing bio-oil.

20 Claims, 1 Drawing Sheet

REMOVAL OF WATER FROM BIO-OIL

BACKGROUND

1. Field of the Invention

The present invention relates generally to the treatment of bio-oil. More specifically, the invention concerns processes and systems for removing water from bio-oil.

2. Description of the Related Art

With its low cost and wide availability, biomass has increasingly been emphasized as an ideal feedstock in alternative fuel research. Consequently, many different conversion processes have been developed that use biomass as a feedstock to produce useful biofuels and/or specialty chemicals. Existing biomass conversion processes include, for example, combustion, gasification, slow pyrolysis, fast pyrolysis, liquefaction, and enzymatic conversion. One of the useful products that may be derived from the aforementioned biomass conversion processes is a liquid product commonly referred to as "bio-oil." Bio-oil may be processed into transportation fuels, hydrocarbon chemicals, and/or specialty chemicals.

Despite recent advancements in biomass conversion processes, many of the existing biomass conversion processes produce bio-oils containing high amounts of water. These bio-oils with excess water are not readily miscible with hydrocarbons due to their high polarity and, thus, require extensive secondary upgrading in order to be utilized as transportation fuels, hydrocarbon chemicals, and/or specialty chemicals.

Bio-oils can be subjected to various separation methods in order to remove the excess water. Such separation methods may utilize distillation columns and/or total condensers to condense all the bio-oil and water for separation. However, many valuable water-soluble organic compounds are incidentally removed during these water removal processes, thus decreasing the bio-oil yield. A portion of these water-soluble organic compounds may be subsequently recovered from the removed water, but such processes have proven to be costly and energy inefficient.

Accordingly, there is a need for an improved process and system for removing water from bio-oil that maximizes energy efficiency.

SUMMARY OF THE INVENTION

In one embodiment, the present invention is directed to a bio-oil treatment process comprising the steps of (a) thermochemically converting biomass in a conversion reactor to thereby produce a conversion effluent comprising vapor conversion products; (b) partially condensing at least a portion of the vapor conversion products in a partial condenser to thereby produce a first water-rich overhead stream comprising noncondensable gases, water, and light organic compounds and a first water-depleted stream comprising condensed bio-oil; (c) separating at least a portion of the first water-rich overhead stream in a separator to thereby produce a second water-rich stream comprising water and water-soluble light organic compounds and a second water-depleted stream comprising the water-insoluble light organic compounds; and (d) introducing a reflux stream into the partial condenser. The reflux stream may comprise at least a portion of the first water-depleted stream and/or at least a portion of the second water-depleted stream.

In another embodiment, the present invention is directed to a bio-oil treatment process comprising the steps of (a) thermochemically converting biomass in a conversion reactor to thereby produce a conversion effluent comprising vapor conversion products; (b) partially condensing at least a portion of the vapor conversion products in a partial condenser to thereby produce a first water-rich overhead stream comprising noncondensable gases, water, and light organic compounds and a first water-depleted stream comprising condensed bio-oil; (c) separating at least a portion of the first water-rich overhead stream in a separator to thereby produce a second water-rich stream comprising water and water-soluble light organic compounds and a second water-depleted stream comprising water-insoluble light organic compounds; and (d) fractionating at least a portion of the second water-rich stream in a fractionator to thereby produce a third water-rich stream comprising water and a third water-depleted stream comprising water-soluble light organic compounds.

In a further embodiment, the present invention is directed to a bio-oil producing system comprising a biomass feedstock source for providing solid particulate biomass; a conversion reactor for thermally converting at least a portion of the solid particulate biomass feedstock into condensable vapor conversion products; a partial condenser for partially condensing at least a portion of the condensable vapor conversion products into a first water-rich overhead stream and a first water-depleted stream comprising condensed bio-oil, wherein the partial condenser comprises a reflux inlet; a condenser for condensing at least a portion of the first water-rich overhead stream to thereby produce a second water-depleted stream and second water-rich stream; a reflux system for routing at least a portion of the second water-depleted stream to the reflux inlet of the partial condenser; and a fractionator for separating at least a portion of the second water-rich stream to thereby produce a third water-rich stream and a third water-depleted stream.

BRIEF DESCRIPTION OF THE FIGURES

Embodiments of the present invention are described herein with reference to the following drawing figures, wherein.

DETAILED DESCRIPTION

Figure 1:
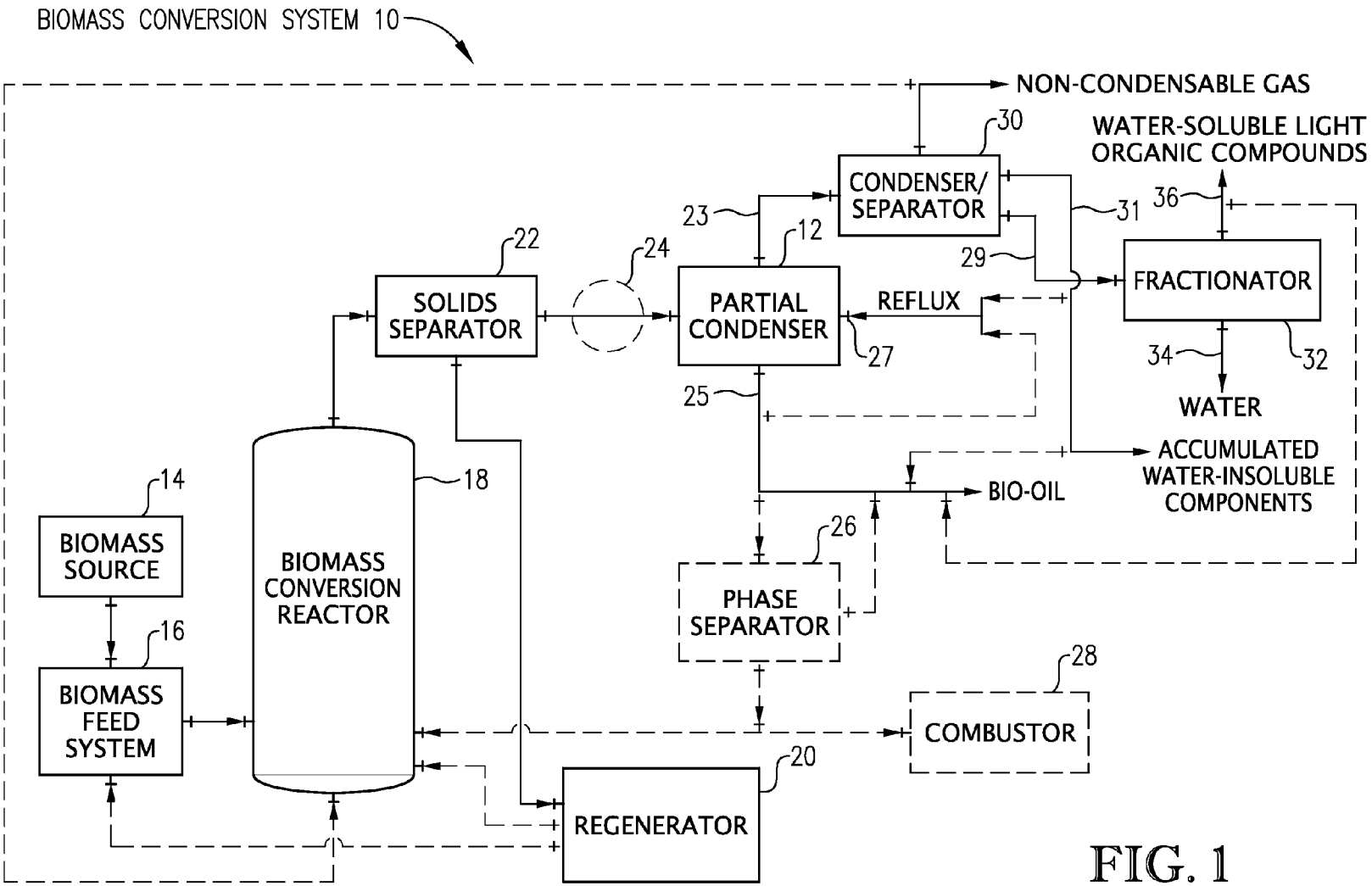
FIG. 1 is a schematic diagram of a biomass conversion system according to one embodiment of the present invention.

FIG. 1 depicts a biomass conversion system 10 that employs a partial condenser 12 to partially condense at least a portion of the vapor conversion products. The streams exiting the partial condenser 12 can then be subjected to further separation and processing in a manner that provides for more effective and efficient removal of water from bio-oil. It should be understood that the biomass conversion system shown in FIG. 1 is just one example of a system within which the present invention can be embodied. The present invention may find application in a wide variety of other systems where it is desirable to efficiently and effectively remove water from bio-oil. The exemplary biomass conversion system illustrated in FIG. 1 will now be described in detail.

The biomass conversion system 10 of FIG. 1 includes a biomass source 14 for supplying a biomass feedstock to be converted to bio-oil. The biomass source 14 can be, for example, a hopper, storage bin, railcar, over-the-road trailer, or any other device that may hold or store biomass. The biomass supplied by the biomass source 14 can be in the form of solid particles. The biomass particles can be fibrous biomass materials comprising cellulose. Examples of suitable cellulose-containing materials include algae, paper waste, and/or cotton linters. In one embodiment, the biomass particles can comprise a lignocellulosic material. Examples of suitable lignocellulosic materials include forestry waste such as wood chips, saw dust, pulping waste, and tree branches; agricultural waste such as corn stover, wheat straw, and bagasse; and/or energy crops such as eucalyptus, switch grass, and coppice.

As depicted in FIG. 1, the solid biomass particles from the biomass source 14 can be supplied to a biomass feed system 16. The biomass feed system 16 can be any system capable of feeding solid particulate biomass to a biomass conversion reactor 18. While in the biomass feed system 16, the biomass material may undergo a number of pretreatments to facilitate the subsequent conversion reactions. Such pretreatments may include drying, roasting, torrefaction, demineralization, steam explosion, mechanical agitation, and/or any combination thereof.

In one embodiment, it may be desirable to combine the biomass with a catalyst in the biomass feed system 16 prior to introducing the biomass into the biomass conversion reactor 18. Alternatively, the catalyst may be introduced directly into the biomass conversion reactor 18. The catalyst may be fresh and/or regenerated catalyst from the regenerator 20. The catalyst can, for example, comprise a solid acid, such as a zeolite. Examples of suitable zeolites include ZSM-5 and zeolite-Y. Additionally, the catalyst may comprise a super acid. Examples of suitable super acids include sulfonated, phosphated, or fluorinated forms of zirconia, titania, alumina, silica-alumina, and/or clays. In another embodiment, the catalyst may comprise a solid base. Examples of suitable solid bases include metal oxides, metal hydroxides, and/or metal carbonates. In particular, the oxides, hydroxides, and carbonates of alkali metals, alkaline earth metals, transition metals, and/or rare earth metals are suitable. Other suitable solid bases are layered double hydroxides, mixed metal oxides, hydrotalcites, clays, and/or combinations thereof. In yet another embodiment, the catalyst can also comprise an alumina, such as alpha-alumina.

It has been found that catalysts for use in this process preferably have proper catalytic activity. Accordingly, catalysts comprising calcined materials are desirable. Suitable examples of calcined materials include clay materials that have been calcined, preferably through the isotherm. Kaolin is an example of a suitable clay. The clay material may comprise oxides, hydroxides, carbonates, or hydroxyl carbonates derived from alkaline earth metals, transition metals, and/or rare earth metals.

It should be noted that solid biomass materials generally contain minerals. It is recognized that some of these minerals, such as potassium carbonate, can have catalytic activity in the conversion of the biomass material. Even though these minerals are typically present during the chemical conversion taking place in the biomass conversion reactor 18, they are not considered catalysts.

The biomass feed system 16 introduces the biomass material into a biomass conversion reactor 18. In the biomass conversion reactor 18, biomass is subjected to a conversion reaction that produces bio-oil. The biomass conversion reactor 18 can facilitate different chemical conversion reactions such as fast pyrolysis, slow pyrolysis, liquefaction, gasification, or enzymatic conversion. The biomass conversion reactor 18 can be, for example, a fluidized bed reactor, a cyclone reactor, an ablative reactor, or a riser reactor.

In one embodiment, the biomass conversion reactor 18 can be a riser reactor and the conversion reaction is fast pyrolysis. More specifically, fast pyrolysis may consist of catalytic cracking. As used herein, "pyrolysis" refers to the chemical conversion of biomass caused by heating the feedstock in an atmosphere that is substantially free of oxygen. In one embodiment, pyrolysis is carried out in the presence of an inert gas, such as nitrogen, carbon dioxide, and/or steam. Alternatively, pyrolysis can be carried out in the presence of a reducing gas, such as hydrogen, carbon monoxide, noncondensable gases recycled from the biomass conversion process, and/or any combination thereof.

Fast pyrolysis is characterized by short residence times and rapid heating of the biomass feedstock. The residence times of the fast pyrolysis reaction can be, for example, less than 10 seconds, less than 5 seconds, or less than 2 seconds. Fast pyrolysis may occur at temperatures between 200 and 1,000° C., between 250 and 800° C., or between 300 and 600° C.

Referring again to FIG. 1, the product exiting the biomass conversion reactor 18 generally comprises gas, vapors, and solids. In the case of fast pyrolysis, the solids in the product exiting the conversion reaction generally comprise particles of char, ash, and/or catalyst. As depicted in FIG. 1, the product from the biomass conversion reactor 18 can be introduced into a solids separator 22. The solids separator 22 can be any conventional device capable of separating solids from gas and vapors such as, for example, a cyclone separator or a gas filter. The solids separator 22 removes a substantial portion of the solids (e.g., spent catalysts, char, and/or heat carrier solids) from the reaction product. The solid particles recovered in the solids separator 22 are introduced into a regenerator 20 for regeneration, typically by combustion. After regeneration, the hot regenerated solids can be reintroduced directly into the biomass conversion reactor 18 and/or combined with the biomass feed upstream of the biomass conversion reactor 18.

The remaining gas and vapor conversion products from the solids separator 22 are introduced into a partial condenser 12. Alternatively, the gas and vapor conversion products from the solids separator 22 may be routed through a cooling mechanism 24 for reducing the temperature of the condensable vapor conversion products prior to being introduced into the partial condenser 12. The cooling mechanism 24 may be any device known in the art that may cool the gas and vapor conversion products. The cooling mechanism 24 can, for example, be a heat exchanger.

The partial condenser 12 reduces the temperature of the vapor conversion products so that the heavy organic compounds (e.g., organic compounds with higher-boiling points, such as benzene derivatives, naphthalene and its derivatives, and indene and its derivatives) condense into liquids, whereas the light organic compounds and water will remain in vapor form. In certain embodiments, the partial condenser 12 reduces the temperature of the vapor conversion products by at least 100° C., 200° C., or 300° C.

As used herein, the term "heavy" denotes compounds that substantially condense under the conditions present in the partial condenser 12. Similarly, the term "light" is used herein to denote compounds that do not substantially condense under the conditions present in the partial condenser 12. As used herein, "substantially condense" means that at least 50 weight percent of the compound condenses.

The partial condenser 12 partially condenses at least a portion of the vapor conversion products to thereby produce a first water-rich overhead stream 23 and a first water-depleted stream 25. As used herein, the terms "rich" and "depleted" designate the concentration of a particular component in a derivate stream compared to the concentration of that component in the original stream from which the derivative stream is derived. Thus, if the concentration of a particular component is greater in a derivative stream than it was in the original stream from which the derivative is derived, then the derivative stream is "rich" in that component. Similarly, if the concentration of a particular component is less in a derivative stream than it was in the original stream from which the derivative is derived, then the derivative stream is "depleted" in that component. To give a specific example, if the feed stream to the partial condenser 12 depicted in FIG. 1 contained 20 weight percent water and the overhead stream exiting the partial condenser contained 50 weight percent water, then the overhead stream exiting the partial condenser 12 would be considered "rich in water" or "water-rich." Similarly, if the feed stream to the partial condenser 12 contained 20 weight percent water and the stream exiting the bottom of the partial condenser 12 contained 5 weight percent water, then the bottom stream exiting the partial condenser 12 would considered "depleted in water" or "water-depleted."

Referring again to FIG. 1, the first water-rich overhead stream 23 comprises noncondensable gases, water, and light organic compounds, whereas the first water-depleted stream 25 comprises condensed bio-oil. The first water-depleted stream 25 can, for example, contain less than 10, 5, 2, or 1 percent by weight of water. The first water-rich overhead stream 23 is removed from the top of the partial condenser 12, while the first water-depleted stream 25 exits at the bottom. The noncondensable gas may be recovered from the partial condenser 12 and recycled for use as at least a portion of the lift gas employed in the biomass conversion reactor 18.

The partial condenser 12 operates at a bottom temperature of at least 115° C., 125° C., 150° C., or 180° C. Additionally, the partial condenser 12 operates at a pressure below that of the biomass conversion reactor 18. In one embodiment, the partial condenser 12 operates at or slightly above ambient pressures. The partial condenser 12 may also employ internal trays and/or packing to facilitate better condensation and/or separation of the vapor conversion products.

In one embodiment, the first water-rich overhead stream 23 is rich in carboxylic acids as it contains at least a majority of the carboxylic acids derived from the vapor conversion products, whereas the first water-depleted stream 25 is depleted in carboxylic acids. In another embodiment, the carboxylic acids are mostly comprised of acetic acid. Consequently, the condensed bio-oil in the first water-depleted stream 25 may have a Total Acid Number (TAN) value that is less than 50, 30, or 20 mg KOH/g.

Referring again to FIG. 1, the first water-depleted stream 25 comprising condensed bio-oil may also comprise a concentrated aqueous phase. The concentrated aqueous phase is generally comprised of water and water-soluble heavy organic compounds. The first water-depleted stream 25 may be introduced into a phase separator 26 to separate at least a portion of the concentrated aqueous phase from the condensed bio-oil. The phase separator 26 may be any device known in the art that may separate and remove the concentrated aqueous phase from the bio-oil, such as a fractionator. Such devices may utilize centrifugal forces, gravitational forces, and/or pressure differentials to separate the phases. At least a portion of the separated concentrated aqueous phase is routed to the biomass conversion reactor 18 or to a combustor 28 for use as a heat source.

In another embodiment, at least a portion of the first water-rich overhead stream 23 is introduced into a condenser/separator 30. In the condenser/separator 30, the first water-rich stream 23 is condensed and separated into a second water-rich stream 29 and second water-depleted stream 31. The second water-rich stream 29 is rich in water-soluble light organic compounds, whereas the second water-depleted stream 31 is rich in water-insoluble light organic compounds. The water-soluble light organic compounds may include, for example, carboxylic acids such as acetic acid, methyl vinyl ketone, and/or cyclopentenone. The water-insoluble light organic compounds may include, for example, toluene, benzene, and/or xylene.

The second water-rich stream 29 and the second water-depleted stream 31 are removed from the condenser/separator 30 as separate liquid streams. Any noncondensable gases produced in the condenser/separator 30 may also be removed from the condenser/separator 30 as a separate stream. At least a portion of the removed noncondensable gases may be recycled as a lift gas in the biomass conversion reactor 18.

In one embodiment, a reflux stream may be introduced into the partial condenser 12 through a reflux inlet 27. The reflux stream provides all or part of the cooling required to partially condense the vapor conversion products in the partial condenser 12. As depicted in FIG. 1, the reflux stream may be provide by one or more of the following streams: the first water-depleted stream 25 and/or the second water-depleted stream 31. In one embodiment, all of the reflux provided to the partial condenser 12 originates from the second water-depleted stream 31.

In one embodiment, the second water-depleted stream 31, which is rich in water-insoluble light organic compounds, may be removed from the condenser/separator 30 and added to the condensed bio-oil from the first water-depleted stream 25. In another embodiment, at least a portion of the second water-depleted stream 31 is removed from the system for subsequent processing.

Referring again to FIG. 1, the second water-rich stream 29 may be removed from the condenser/separator 30 and introduced into a fractionator 32. In the fractionator 32, the second water-rich stream 29 is separated into a third water-rich stream 34 and a third water-depleted stream 36, which is rich in water-soluble light organic compounds. The third water-rich stream 34 may be converted to steam and be used as a lift gas in the biomass conversion reactor 18. In one embodiment, the third water-depleted stream 36 may be added to the condensed bio-oil from the first water-depleted stream 25. In another embodiment, at least a portion of the third water-depleted stream 36 may be removed from the system for subsequent processing.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventor's intent is to rely on the Doctrine of Equivalents to determine and assess the reasonably fair scope of the present invention as it pertains to any processes and systems not materially departing from but outside the literal scope of the invention as set forth in the following claims.

What is claimed is:

1. A process for producing bio-oil, said process comprising:

(a) thermochemically converting biomass in a conversion reactor to thereby produce a conversion effluent comprising vapor conversion products;

(b) partially condensing at least a portion of said vapor conversion products in a partial condenser to thereby produce a first water-rich overhead stream comprising noncondensable gases, water, and light organic compounds and a first water-depleted stream comprising condensed bio-oil, wherein said partial condenser operates at a bottom temperature of at least 115° C.;

(c) separating at least a portion of said first water-rich overhead stream in a separator to thereby produce a second water-rich stream comprising water and water-soluble light organic compounds and a second water-depleted stream comprising water-insoluble light organic compounds; and (d) introducing a reflux stream into said partial condenser, wherein said reflux stream comprises at least a portion of said first water-depleted stream and/or at least a portion of said second water-depleted stream.

2. The process of claim 1 wherein said reflux stream provides at least a portion of the cooling required to partially condense said vapor conversion products in said partial condenser.

3. The process of claim 1 wherein said reflux stream comprises at least a portion of said second water-depleted stream.

4. The process of claim 1 wherein said water-soluble light organic compounds comprise carboxylic acids, methyl vinyl ketones, and/or cyclopentenones, wherein said water-insoluble light organic compounds comprise benzene, toluene, and/or xylene.

5. The process of claim 1 wherein said first water-rich stream is rich in carboxylic acids, wherein said first water-depleted stream is depleted in carboxylic acids.

6. The process of claim 1 wherein said second water-rich stream is rich in said water-soluble light organic compounds, wherein said second water-depleted stream is rich in said water-insoluble light organic compounds.

7. The process of claim 1 wherein said first water-depleted stream further comprises a concentrated aqueous phase comprising water and water-soluble heavy organic compounds, further comprising removing at least a portion of said concentrated aqueous phase from said first water-depleted stream.

8. The process of claim 7 further comprising routing at least a portion of the removed concentrated aqueous phase to said conversion reactor and/or to a combustor for use as a heat source.

9. The process of claim 1 wherein said separating of step (c) includes removing said second water-rich stream and said second water-depleted streams from said separator as separate liquid streams.

10. The process of claim 9 wherein said separating of step (c) includes removing a noncondensable gas stream from said separator as a separate stream from said water-rich and water-depleted streams.

11. The process of claim 10 further comprising routing at least a portion of the removed noncondensable gas stream to said conversion reactor for use as at least a portion of a lift gas in said conversion reactor.

12. The process of claim 1 further comprising fractionating at least a portion of said second water-rich stream in a fractionator to thereby produce a third water-rich stream and a third water-depleted stream, wherein said third water-depleted stream is rich in water-soluble light organic compounds.

13. The process of claim 1 wherein said thermochemically converting of step (a) comprises fast pyrolysis.

14. A process for producing bio-oil, said process comprising:

(a) thermochemically converting biomass in a conversion reactor to thereby produce a conversion effluent comprising vapor conversion products;

(b) partially condensing at least a portion of said vapor conversion products in a partial condenser to thereby produce a first water-rich overhead stream comprising noncondensable gases, water, and light organic compounds and a first water-depleted stream comprising condensed bio-oil, wherein said partial condenser operates at a bottom temperature of at least 115° C.;

(c) separating at least a portion of said first water-rich overhead stream in a separator to thereby produce a second water-rich stream comprising water and water-soluble light organic compounds and a second water-depleted stream comprising water-insoluble light organic compounds; and (d) fractionating at least a portion of said second water-rich stream in a fractionator to thereby produce a third water-rich stream comprising water and a third water-depleted stream comprising water-soluble light organic compounds.

15. The process of claim 14 further comprising introducing a reflux stream into said partial condenser, wherein said reflux stream provides at least a portion of the cooling required to partially condense said vapor conversion products in said partial condenser, wherein said reflux stream comprises at least a portion of said second water-depleted stream.

16. The process of claim 14 wherein said water-soluble light organic compounds comprise carboxylic acids, methyl vinyl ketones, and/or cyclopentenones, wherein said water-insoluble light organic compounds comprise benzene, toluene, and/or xylene, wherein said first water-rich stream is rich in carboxylic acids, wherein said first water-depleted stream is depleted in carboxylic acids, wherein said second water-rich stream is rich in said water-soluble light organic compounds, wherein said second water-depleted stream is rich in said water-insoluble light organic compounds.

17. The process of claim 14 wherein said separating of step (c) includes removing said second water-rich stream and said second water-depleted streams from said separator as separate liquid streams.

18. The process of claim 17 wherein said separating of step (c) includes removing a noncondensable gas stream from said separator as a separate stream from said water-rich and water-depleted streams.

19. A system for producing bio-oil, said system comprising:

a biomass feedstock source for providing solid particulate biomass;

a conversion reactor for thermally converting at least a portion of said solid particulate biomass feedstock into condensable vapor conversion products;

a partial condenser for partially condensing at least a portion of said condensable vapor conversion products into a first water-rich overhead stream and a first water-depleted stream comprising condensed bio-oil, wherein said partial condenser comprises a reflux inlet, wherein said partial condenser is configured to operate at a bottom temperature of at least 115° C.;

a condenser for condensing at least a portion of said first water-rich overhead stream to thereby produce a second water-depleted stream and second water-rich stream;

a reflux system for routing at least a portion of said second water-depleted stream to said reflux inlet of said partial condenser; and a fractionator for separating at least a portion of said second water-rich stream to thereby produce a third water-rich stream and a third water-depleted stream.

20. The system of claim 19 further comprising a phase separator for separating at least a portion of said first water-depleted stream into a bio-oil stream and a concentrated aqueous stream.

* * * * *